US007647736B2

(12) United States Patent
Dion

(10) Patent No.: US 7,647,736 B2
(45) Date of Patent: Jan. 19, 2010

(54) I BEAM PROTECTOR

(76) Inventor: Dany Dion, 7850 des Géraniums, La Plaine, Quebec (CA) J7M 2J8

( * ) Notice: Subject to any disclaimer, the term of this patent is extended or adjusted under 35 U.S.C. 154(b) by 176 days.

(21) Appl. No.: 11/651,869

(22) Filed: Jan. 10, 2007

(65) Prior Publication Data

US 2007/0240379 A1 Oct. 18, 2007

(30) Foreign Application Priority Data

Apr. 13, 2006 (CA) ..... 2543416

(51) Int. Cl.
*E04H 12/28* (2006.01)

(52) U.S. Cl. ..... 52/244; 52/300; 52/837; 52/DIG. 12

(58) Field of Classification Search ..... 52/300, 52/301, 729.1, 837, DIG. 12, 244
See application file for complete search history.

(56) References Cited

U.S. PATENT DOCUMENTS 2,166,798 A * 7/1939 Cote ..... 264/248
3,680,903 A * 8/1972 Hulten ..... 293/142
4,088,229 A * 5/1978 Jacoby et al. ..... 211/191
5,369,925 A * 12/1994 Vargo ..... 52/244
5,709,057 A * 1/1998 Johnson et al. ..... 52/301
5,894,946 A * 4/1999 Darnell et al. ..... 211/193
5,946,871 A * 9/1999 Kassardjian et al. ..... 52/301
6,390,719 B1 * 5/2002 Chan ..... 403/205
7,028,808 B2 * 4/2006 Zeaman ..... 182/108
7,104,514 B2 * 9/2006 Ciarlo ..... 248/345.1

* cited by examiner

*Primary Examiner*—Richard E Chilcot, Jr.
*Assistant Examiner*—Chi Q Nguyen
(74) *Attorney, Agent, or Firm*—Eric Fincham

(57) ABSTRACT

A protective device for use in protecting an end of an I beam, the protective device comprising a front element having a front, a rear and a pair of sides, the sides being formed of first and second side walls which taper inwardly from the rear to form a narrow front surface, and an element for securing the front element to the end of the I beam.

14 Claims, 2 Drawing Sheets

I BEAM PROTECTOR

FIELD OF THE INVENTION

The present invention relates to a protective device and more particularly, relates to a protective device for the end of an I beam.

BACKGROUND OF THE INVENTION

I beams are a standard structural component and are widely used for many different applications. Thus, they are used as load bearing members in many types of buildings. Another use which I beams receive is as support members for construction material such as lengths of lumber, sheet material such as plywood or gyproc, etc.

I beams are utilized for such purposes as they have the necessary strength and the rigidity to withstand the substantial loads which are placed thereon. One problem which has been encountered is the damage to the end of the exposed I beam when fork lift trucks or other vehicles place merchandise on the I beams. Thus, often the forks on the lift truck will hit the I beam and damage the same. As will be appreciated, the replacement of the I beam becomes a substantial expense for the retailer.

SUMMARY OF THE INVENTION

It is an object of the present invention to provide an I beam protective device and which I beam protective device is suitable for use on the ends of I beams.

According to one aspect of the present invention, there is provided a protective device for use in protecting an end of an I beam from damage, the protective device comprising a front element having a front, a rear, and a pair of sides, the sides being formed of first and second side walls, at least one of said side walls tapering inwardly from said rear to form a narrow front surface, and means for securing said front element to said end of said I beam.

In a further aspect of the present invention, in a facility having racks formed of a plurality of I beams and where at least one of the I beams has an exposed end, there is provided the improvement comprising a protective member mounted on the exposed end, the protective member comprising a front element having first and second side walls, at least one of the side walls tapering inwardly from adjacent the exposed end to form a narrow front surface, and means for securing the front element to the end of the I beam.

In greater detail, the protective device of the present invention preferably comprises two components, a first one forming the protective configuration with a second component being used to secure the front component or element to the end of the I beam. Such an arrangement allows for the replacement of only the front element or component should damage occur.

Preferably, the front element has first and second side walls which extend from the rear of the device inwardly to form a relatively narrow front surface. The front surface could, in fact, be a point; however, it is preferred that it be slightly rounded to have a convex configuration.

A top wall extends between the first and second side walls, the top wall sloping downwardly from the rear to meet the narrow front surface and to thereby form a further deflective surface in addition to the two side walls.

The rear element, comprising the mounting member, is attached to the I beam by suitable means. Thus, it could either be welded directly to the I beam or more preferably, is secured thereto by mechanical means such as nuts and bolts.

The front element is preferably releasably secured to the mounting member and while different arrangements may be employed, a preferred arrangement comprises the mounting member having a channel formed therein, the channel being sized and arranged to receive inwardly extending flanges along the rear of the front element.

Preferably, the front element and the mounting member are each formed of a suitable metallic material such as steel. In one preferred embodiment, the I beam is the lower most one proximate the floor of the warehouse or facility. To facilitate securing of the same, the secondary component may have a triangularly shaped portion with an aperture therein designed to receive a fastening member.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
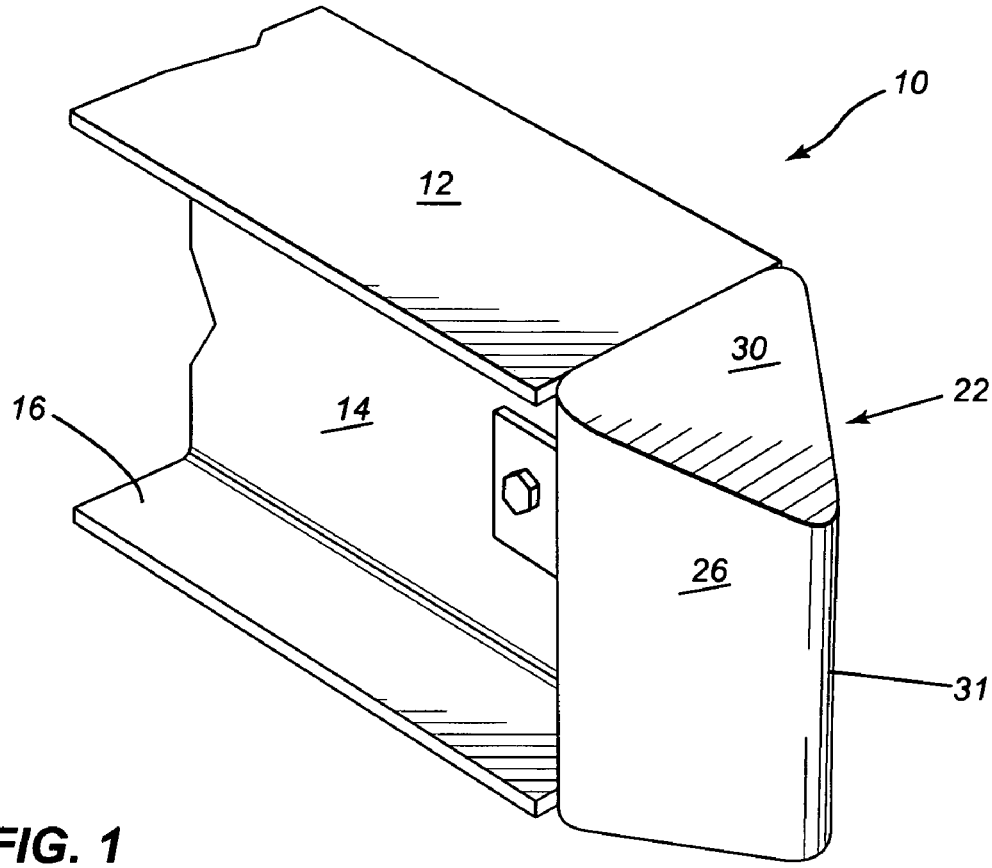
FIG. 1 is a perspective view of the end of an I beam having the protective device of the instant invention secured thereto.
Figure 2:
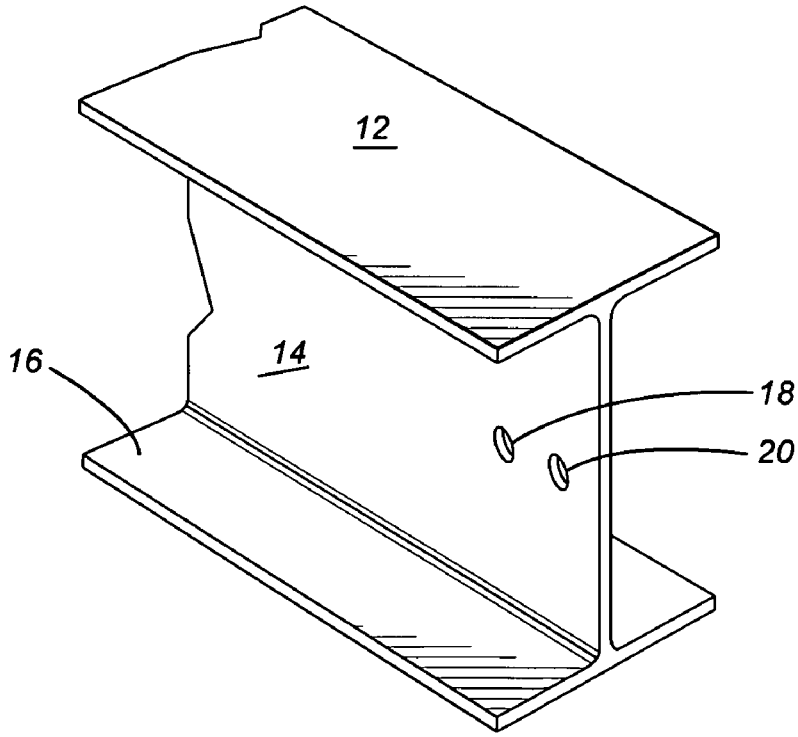
FIG. 2 is a perspective view of the I beam end.

Referring to the drawings in greater detail and by reference characters thereto, there is illustrated in FIGS. 1 and 2 an end portion of a conventional I beam generally designated by reference numeral 10. I beam 10 includes an upper flange 12, a central rib 14, and a lower flange 16. As may be seen in FIG. 2, first and second apertures 18 and 20 are provided in central rib 14 near the end of I beam 10.

Figure 3:
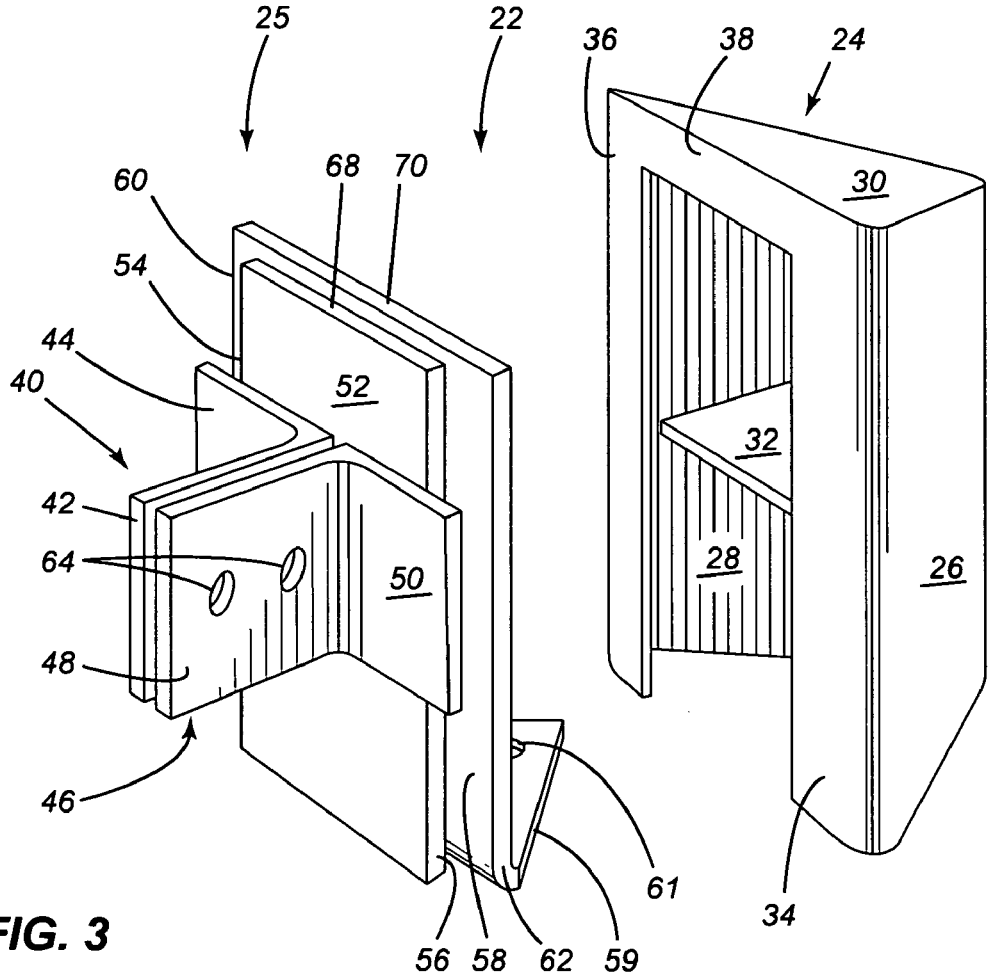
FIG. 3 is an exploded view showing the front element and mounting member.
Figure 4:
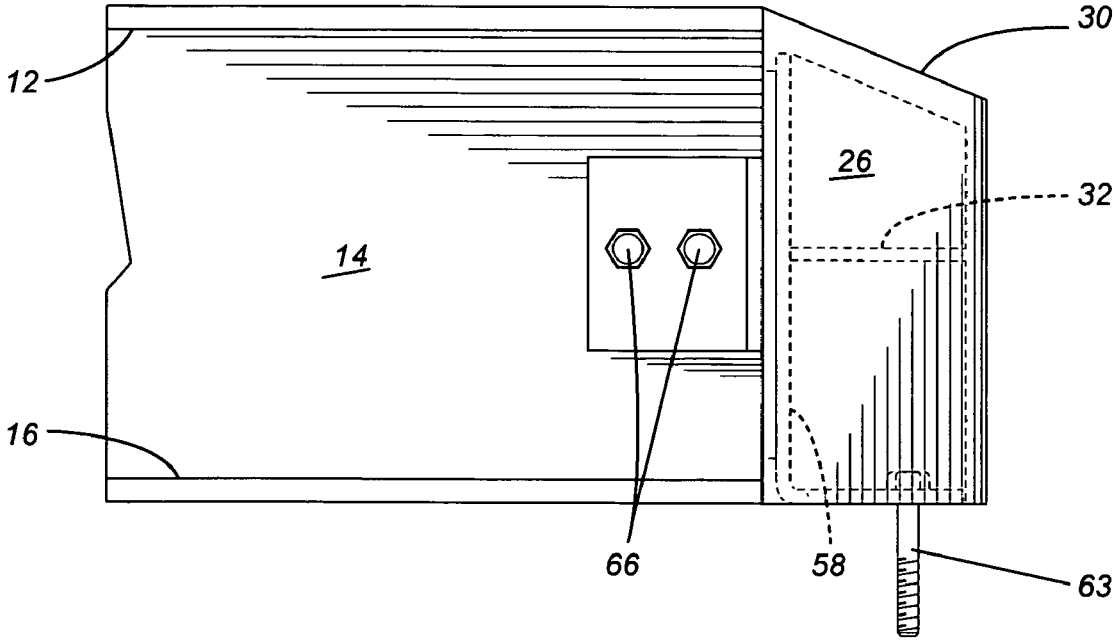
FIG. 4 is a side elevational view of the protective device mounted on the I beam.

The protective device of the present invention is generally designated by reference numeral 22 and is best seen in FIG. 3. Protective device 22 includes a front element generally designated by reference numeral 24 and a mounting member generally designated by reference numeral 25.

Front element 24 has a first side wall 26 and a second side wall 28 with a top wall 30 extending therebetween. The arrangement is such that side walls 26 and 28 taper inwardly towards the front to provide a relatively narrow convex front wall 31. Mounted interiorly of side walls 26 and 28 is a reinforcing element 30.

At the rear, there is provided a first rear wall flange 34 which extends inwardly from side wall 26 and a second rear wall flange 36 which extends inwardly from side wall 28. It will be noted that both flanges 34 and 36 are spaced from reinforcing element 32. There is also provided a top wall flange 38 which extends downwardly from the end of top wall 30.

Mounting member 25 is comprised of a first L-shaped bracket generally designated by reference numeral 40. L-shaped bracket 40 includes a first leg 42 and a second leg 44. Similarly, a second L-shaped bracket generally designated by reference numeral 46 includes a first leg 48 and a second leg 50. Second legs 44 and 50 are secured to a spacer plate 52 typically by welding though other mechanical arrangements could be utilized. It will be noted that first legs 42 and 48 are spaced apart the width of rib 14 of I beam 10 and apertures 64 are provided therein to align with apertures 18 and 20 of I beam 10.

Spacer plate 52 has a pair of side walls 54 and 56 which extend inwardly of the end of legs 44 and 50 respectively.

A channel plate 58 is secured to the outer face of spacer plate 52, again preferably by welding. However, edges 60 and 62 of channel plate 60 extend outwardly a distance approximately equivalent to second legs 44 and 50 such that a channel is defined on each side between second leg 44 and channel plate 58 and second leg 50 and channel plate 58. The arrangement is such that rear wall flanges 36 and 34 will fit within the channels. Channel plate 58 also includes, at its lower edge, a triangularly shaped portion 59. As may be seen in FIG. 3, triangularly shaped portion 59 has an aperture 61 formed therein designed to receive a bolt 63 which may be secured to the floor when secured on the lower most I beam.

It will also be noted that top edge 68 of spacer plate 52 is situated below top edge 70 of channel plate 58. This permits the top edge of portion 38 to rest on the top edge 68 of spacer plate 52.

It will be understood that the above described embodiments are for purposes of illustration only and that changes and modifications may be made thereto without departing from the spirit and scope of the invention.

I claim:

1. A protective device for use in protecting an end of an I beam from damage, said protective device comprising:

a front element having a front, a rear, and a pair of sides, said sides being formed of first and second side walls, at least one of said side walls tapering inwardly from said rear to form a narrow front surface, a top wall extending between and terminating at said first and second side walls; and means for securing said front element to said end of said I beam.

2. The protective device of claim 1 wherein both of said first and second side walls taper inwardly to form said narrow front surface.

3. The protective device of claim 2 wherein said narrow front surface has a convex configuration.

4. The protective device of claim 2 wherein said top wall slopes downwardly from said rear to said narrow front surface.

5. The protective device of claim 2 wherein said front element and said mounting member are formed of a metallic material.

6. The protective element of claim 1 wherein said means for securing said front element to an end of said I beam comprises a mounting member, said mounting member being fixedly secured to said I beam, said mounting member having means to removably receive said front element.

7. The protective device of claim 6 wherein said mounting member comprises brackets designed to be mechanically secured to said I beam, said mounting member having vertically extending channels to receive said front element.

8. The protective element of claim 7 wherein said front element includes a plate spaced from said brackets, the space between said plate and said brackets defining said vertically extending channels, said front element having first and second rear wall flanges extending inwardly from a respective rear edge of said first and second side walls, said first and second rear wall flanges fitting within said vertically extending channels.

9. In a facility having racks formed of a plurality of I beams and where at least one of said I beams has an exposed end, the improvement comprising a protective member mounted on said exposed end, said protective member comprising a front element having first and second side walls, at least one of said side walls tapering inwardly from adjacent said exposed end to form a narrow front surface, a top wall extending between said first and second side walls and means for securing said front element to said end of said I beam.

10. The improvement of claim 9 wherein said first and second side walls each taper inwardly to form said narrow front surface.

11. The improvement of claim 10 wherein said narrow front surface has a convex configuration.

12. The improvement of claim 10 wherein said top wall slopes downwardly from adjacent said exposed end to said narrow front surface.

13. The improvement of claim 10 wherein said protective member includes means for securement to a substrate.

14. The improvement of claim 9 wherein said protective number is mounted on the lowermost of said I beams.

* * * * *